United States Patent [19]

Labbe et al.

[11] 4,121,596

[45] Oct. 24, 1978

[54] CIGARETTE MAKING MACHINES

[75] Inventors: Francis A. M. Labbe, Neuilly-sur-Seine, France; Robert E. Williams, London, England

[73] Assignee: Molins Limited, London, England

[21] Appl. No.: 607,974

[22] Filed: Aug. 26, 1975

[51] Int. Cl.[2] ..... A24B 1/02; A24B 3/06; A24B 7/14

[52] U.S. Cl. ..... 131/109 B

[58] Field of Search ..... 131/109, 108, 109 B, 131/110, 84 R, 64 C, 21 D, 30, 143, 146

[56] References Cited

U.S. PATENT DOCUMENTS

| | | | |
|---|---|---|---|
| 2,416,020 | 2/1947 | Ruau | 131/109.3 |
| 2,989,055 | 6/1961 | Labbe | 131/109 R X |
| 3,196,880 | 7/1965 | Pinkham | 131/109 R X |
| 3,450,311 | 6/1969 | Bonneric | 131/109 B X |
| 3,561,552 | 2/1971 | Rischke | 131/109 R |

*Primary Examiner*—Stephen C. Pellegrino
*Attorney, Agent, or Firm*—John C. Smith, Jr.

[57] ABSTRACT

A hopper for a cigarette making machine has two spiked feed rollers and two cooperating high-speed spiked rollers which feed tobacco from tobacco space and onto a spiked drum; this drum feeds the tobacco along part of its path of conveyance and then cooperates with a second drum so as to stretch out lumps in the tobacco while the tobacco is being carried by the second drum. Alternatively the tobacco may be delivered by the spiked rollers onto a ramp; loose particles of tobacco slide all the way down the ramp, whereas lumps of tobacco are picked up by spiked drum which is slightly spaced from the ramp and which returns the lumps to the ramp after they have been opened out.

23 Claims, 8 Drawing Figures

2
4
6
8A
10
10A
8
14
12
22
20
16
18
4A
6A
28
24
30
26
26
34
34
32
36
38
38
40
52
54
42
44
50
46
48
30'
34A
36'

150
152
154

156
162
160
158
166
164
170
168
172

CIGARETTE MAKING MACHINES

This invention is concerned with the hoppers of cigarette making machines. The hopper of a cigarette making machine is used to form a metered flow of tobacco which may be received intermittently by the machine. The metered flow is converted, in another part of the machine, into a cigarette filler stream which is enclosed in a wrapper to form a cigarette rod.

In this context the term "tobacco" is intended to include tobacco substitutes; and the term "cigarette" is intended to include other similar rod-like articles for smoking, for example small cigars which are made in a similar manner to cigarettes.

There are various aspects to this invention which may be used separately or in any desired combination.

According to one aspect of this invention, a hopper for a cigarette making machine comprises downwardly extending fixed walls defining between them a tobacco space into which tobacco is delivered; two spiked feed rollers mounted for rotation in opposite directions about substantially parallel axes and situated at the lower end of the tobacco space, the rollers being rotated in directions such that each roller feeds downwards a stream of tobacco passing between the roller and a part of the adjacent fixed wall; and including two additional spiked rollers arranged respectively to project the tobacco downwards from the two feed rollers.

The additional spiked rollers preferably rotate at a significantly higher speed than the feed rollers. Preferably each additional roller rotates in the same direction as the feed roller above it.

One use of this aspect of the invention is in feeding tobacco, from a relatively thick column in the tobacco space, as a substantially thinner carpet. This invention enables the tobacco from the tobacco space to be fed downwards as two separate streams into two separate channels from which tobacco can be fed alternately in the desired relatively thin carpet formation. For this purpose, the spikes of the feed rollers preferably sweep through overlapping areas to ensure that substantially no tobacco passes between the feed rollers. The two channels below the feed rollers may be defined by two fixed walls and by a pivoted member which lies between the fixed walls and is pivoted at its upper end so that it can be moved between two positions in which it allows tobacco to pass down one or other channel while arresting the flow of tobacco through the other channel; for example, the pivoted member may remain in each position for a predetermined time (for example about 6 seconds) to allow tobacco to pass from one channel, and then swing over to the other position in which it allows tobacco which has accumulated in the other channel to pass downwards while it holds up the flow of tobacco in the first channel.

For the purpose of feeding tobacco from the tobacco space into two separate channels, in the case of relatively short tobacco it may be possible to omit the additional rollers.

According to another aspect of this invention, a hopper for a cigarette making machine includes a first spiked conveyor which, along a portion of its spiked surface, is arranged to carry tobacco along part of its path of conveyance through the hopper, and including a second spiked conveyor which carries the tobacco along another part of its path of conveyance through the hopper, a second portion of the first spiked conveyor being arranged to cooperate with the second spiked conveyor to provide a refusing, lump-stretching or similar action on the tobacco while it is being carried by the second spiked conveyor.

By this arrangement, the first spiked conveyor serves two purposes. That is to say, it serves to convey tobacco along part of its path of conveyance, and it also serves to refuse or similarly act on tobacco while it is being carried by the second spiked conveyor. In a preferred arrangement, the tobacco is received by the second spiked conveyor after leaving the first spiked conveyor, but the inverse is possible. In the preferred arrangement, the cooperating parts of the two spiked conveyors preferably move in substantially the same direction, the speed of the second spiked conveyor being higher than that of the first spiked conveyor.

According to another aspect of this invention, a hopper for a cigarette making machine comprises means for feeding tobacco onto a ramp; a spiked conveyor which is mounted adjacent to but slightly spaced from the ramp so that it allows loose particles of tobacco to slide past it down the ramp, but picks up lumps of tobacco; and means for opening up the lumps of tobacco and for then delivering that tobacco onto the stream of loose tobacco.

This arrangement is particularly useful in a machine in which the tobacco is delivered into a downwardly extending channel in which it builds up to form a column of tobacco, tobacco being continuously fed from the lower end of the channel towards the device for forming a cigarette filler stream. In such an arrangement, the ramp may extend to the upper end of the channel so that loose particles of tobacco slide from the ramp directly into the channel; the tobacco which is opened up by the spiked conveyor may be delivered onto the ramp so as to join the stream of loose particles, or may be delivered directly into the channel.

Examples of hoppers for cigarette making machines according to this invention are shown in the accompanying drawings. In these drawings.

Figures 1, 2:
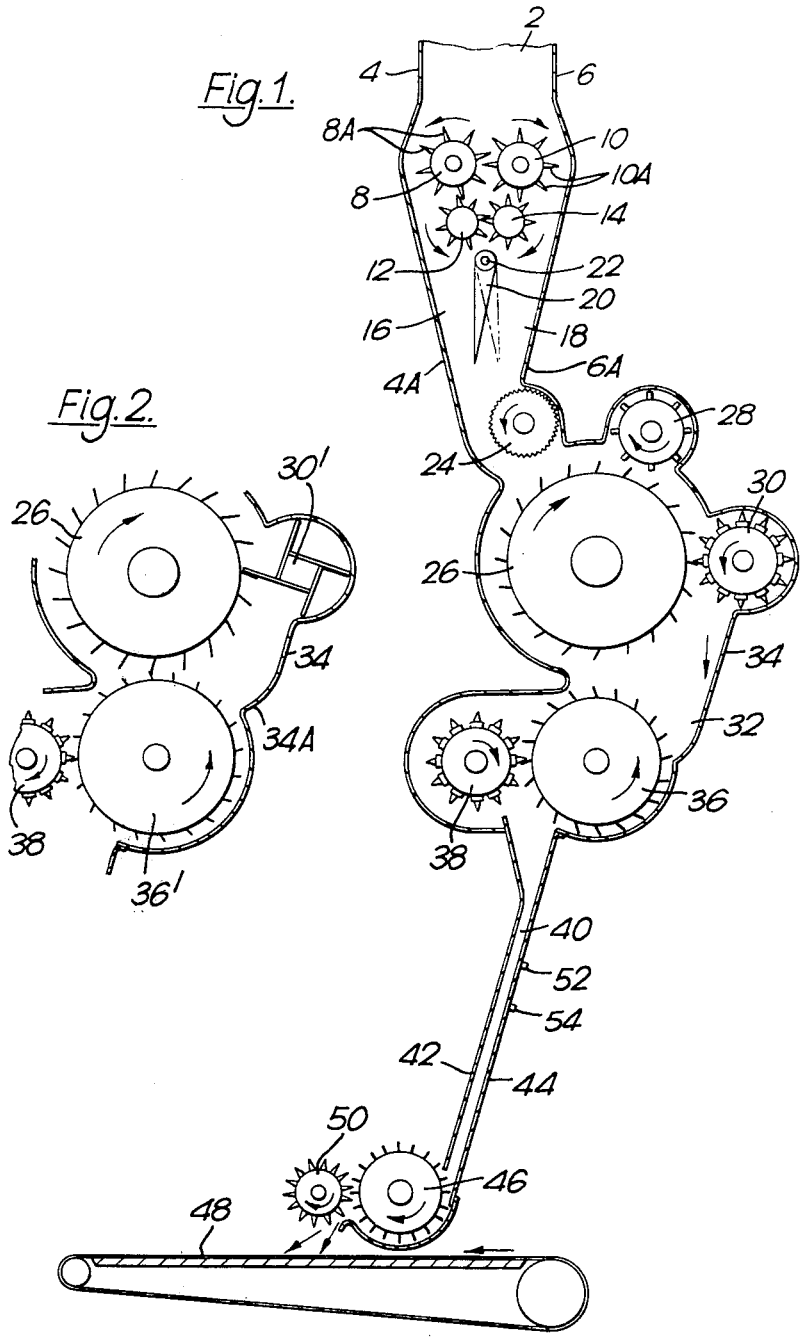
FIG. 1 is a diagrammatic cross-section in a vertical plane through one hopper.
FIG. 2 shows a modification of part of the hopper shown in FIG. 1.

The hopper shown in FIG. 1 has a tobacco space 2 formed between vertical front and back walls 4 and 6. The distance between the walls 4 and 6 may for example be approximately 150 millimeters.

Below the tobacco space 2 there are two parallel spiked feed rollers 8 and 10 which rotate in opposite directions, as shown, to feed tobacco from the space 2 as two streams which pass along the outside of the rollers 8 and 10, i.e. between the rollers and downward extensions of the walls 4 and 6. It should be noted that the areas swept by the spikes 8A and 10A of the rollers 8 and 10 overlap. Furthermore it should be noted that the tips of the spikes of each of the rollers pass close to the main body of the other roller.

Below the feed rollers 8 and 10 there are two additional spiked rollers 12 and 14 which rotate in opposite directions and at a speed greater than the speed of the rollers 8 and 10. The areas swept by the spikes of the rollers 12 and 14 overlap, while the areas swept by the rollers 12 and 14 overlap respectively also with the areas swept by the spikes of the roller 8 and 10. Thus the rollers 12 and 14 help to remove any tobacco which might tend to remain on the rollers 8 and 10, and project the tobacco downwards.

It will be noted that the rollers 8 and 10 are timed so that their spikes intermesh so as not to hit one another and in order to handle the tobacco smoothly; in addition, or as an alternative, the spikes may be arranged in axially spaced groups each comprising a ring of spikes around the roller, and the groups on the two rollers may be axially staggered so as to miss one another. The spikes on the rollers 12 and 14 may be similarly arranged, but are in addition arranged to pass between the spikes of the rollers 8 and 10; the spikes on the rollers 12 and 14 may be in the form of teeth, e.g. approximately involute-shaped and somewhat similar to gear teeth.

The two streams of tobacco fed downwards by the spiked rollers enter two channels 16 and 18. These are formed by downward extensions 4A and 6A of the walls 4 and 6 and by a central flap 20 which is pivoted about a horizontal axis by a shaft 22. The flap is shown in solid outline in a position in which it allows tobacco to pass downwards through the channel 18 and holds up the flow of tobacco through the channel 16. The reverse situation applies when the flap is in the position shown in broken outline.

Each of the channels 16 and 18 preferably diverges slightly in a downward direction when the flap 20 is in the position necessary to feed tobacco down that channel. For example, each channel may increase in width from 52 mm at its upper end to 55 mm at its lower end.

Thus a stream of tobacco is drawn alternately from the channels 16 and 18 and is fed downwards by a ribbed roller 24. The tobacco is then carried further on the surface of a spiked drum 26 which rotates in a clockwise direction. A cleaner roller 28 serves to iron out any occasional lumps of tobacco on the drum 26, and a picker roller 30 then strips the tobacco from the drum 26 and projects it downwards into a well 32. This well is formed between a fixed wall 34 and a smaller spiked drum 36 which has a tobacco-carrying capacity and rotates at a constant speed high enough to carry the tobacco from the well 32 substantially immediately it arrives in the well 32; in other words, there is no significant accumulation of tobacco in the well 32. A second picker roller 38 then removes the tobacco from the drum 36 and projects it downwards into a narrow channel 40.

The channel 40 is defined by a front wall 42 and rear wall 44 which diverge slightly in a downward direction. For example, the walls 42 and 44 may be spaced apart by a distance of 17 mm at their upper ends and by a distance of 20 mm at their lower ends. One of the walls 42 and 44 may be adjustable slightly to allow the thickness of the channel 40 to be varied to take into account different tobacco characteristics; for example, the thickness of the channel may be adjusted to produce a predetermined tobacco density (e.g. 120 mg/cc) in the bottom end of the channel. Furthermore, the wall 42 may be vibrated in order to facilitate the feed of tobacco through the channel 40, as described in U.S. patent appln. Ser. No. 415,470, now abandoned, (and corresponding German Specification No. 2357 132), to which reference is directed in its entirety.

The tobacco which piles up in the channel 40 forms what may be termed a "carpet". This carpet is fed from the lower end of the channel 40 by a further spiked drum 46, and the tobacco is then removed from this drum and fed onto a band 48 by a picker roller 50.

The height of the tobacco in the channel 40 is kept between upper and lower limits by photo-electric or other height monitoring devices 52 and 54. For this purpose, the rate at which tobacco is fed into the channel 40 is variable. For example, the drum 26 and the feed rollers 8 and 10 and possibly also the drum 36 may have two sets of speeds, the upper and lower speeds being brought into operation when necessary in response to the monitoring devices 52 and 54; in this respect the arrangement may be similar to that described in the above-mentioned patent application.

The width of all parts of the hopper, measured along the axes of the various rollers and drums, may be equal throughout to the width of the carpet delivered by the drum 46. Alternatively, the width of the hopper at the top may be slightly less than that of the carpet, and the width available for the tobacco increases progressively from the top of the hopper to the bottom to avoid or reduce ill effects arising from the Poisson ratio of the tobacco.

The speed or mean speed of the feed rollers 8 and 10 may, for example, be approximately 6 revolutions per minute in order to feed 10 lbs/min. of tobacco. If a greater quantity of tobacco is required to be fed, for example 15 lbs/min., the speed may be increased proportionately.

The spiked rollers 12 and 14 may have a speed of about 52 revolutions per minute.

The spiked rollers 12 and 14 may in some circumstances be omitted.

It is possible (especially when the tobacco is not very tangled or dense) to omit the flap 20, though in this case the feed rollers 12 and 14 should preferably be included and may rotate at a slightly higher speed, e.g. 60 revolutions per minute. In that case the ribbed roller 24 does not receive alternate streams from opposite feed rollers. Instead, the feed rollers 8 and 10 and spiked rollers 12 and 14 serve mainly to stretch out the tobacco and to accelerate it so as to shower it in a relatively loose state and at a fairly constant rate onto the carded drum 26.

The position of the flap 20 may be controlled by any convenient mechanical device, for example by a cam operating on a follower arm carried by the shaft 22 by which the flap is pivotally mounted.

The following modification is possible. The drum 36 and picker roller 38 may be omitted, and the channel 40 may be positioned below the picker roller 30 so as to receive tobacco directly from the carded drum 26. In that case the thickness of the channel 40 should be increased, for example to 25 mm or more.

FIG. 2 shows a modification of part of the hopper of FIG. 1. The drum 26 is unchanged, but the picker roller 30 is replaced by a flapper roller 30' consisting of a square-section central body with four sets of flexible flaps which project from the sides of the central body as shown, each set comprising a number of axially spaced flap portions which pass between the spikes of the drum 26. The drum 36 is replaced by a drum 36' which is close to the drum 26, so that the spikes of the drum 26 can act to stretch out lumps of tobacco carried by the drum 36', for that purpose the drum 36 rotates with a peripheral speed higher than that of the drum 26. It should be noted also that the wall 34 terminates at its lower end with a portion 34A which is inclined to the horizontal while being substantially radial with respect to the drum 36'.

The band 48 is preferably positioned lower down than is shown in FIG. 1, so as to allow the tobacco shower delivered by the picker roller to spread horizontally along the band.

Figure 3:
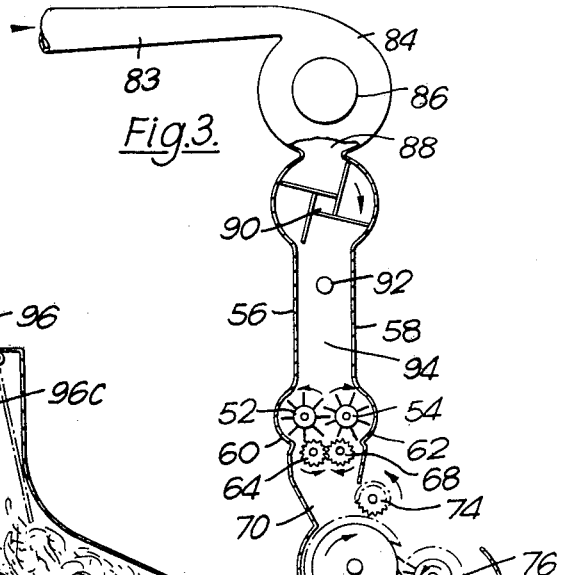
FIGS. 3, 4 and 7 are views, similar to FIG. 1, of other different hoppers.

FIG. 3 shows a different hopper arrangement using a four-roller feed without the flap. Tobacco is fed downwards towards feed rollers 52 and 54 between vertical walls 56 and 58. The rollers 52 and 54 divide the tobacco flow into two streams, one stream passing between the roller 52 and a curved wall 60, while the other stream passes between the roller 54 and a curved wall 62. Rollers 64 and 68 help to remove the tobacco from the spiked rollers 52 and 54, after which the tobacco falls downwards into a well 70 above a carded drum 72. Any large lumps of tobacco on the drum 72 tend to be stretched by a refusar roller 74 so as to produce a relatively even carpet of tobacco on the drum 72. This carpet is then removed by a picker roller 76 which projects the tobacco downwards into a downwardly extending channel defined by walls 78 and 80. A roller 82 at the entry to the channel helps to avoid jamming of tobacco at the entry.

The tobacco is fed into the space 94 between the walls 56 and 58 via a fed arrangement which is as follows. Tobacco is carried in an air stream through a pipe 83 from which it enters an air separator 84. Air passes out of the separator 84 through a sieve outlet 86, while tobacco passes downwards through an outlet 88 and is then fed downwards by a sealing-flap roller 90 which prevents any significant flow of air through the outlet 88. A photo-electric or other device 92 monitors the height of the tobacco in the space 94 and emits a "demand" signal whenever the surface of the tobacco drops below the device 92. There may be two photo-electric devices 92 operating in the manner of the devices 52 and 54 described with reference to FIG. 1.

Figure 5:
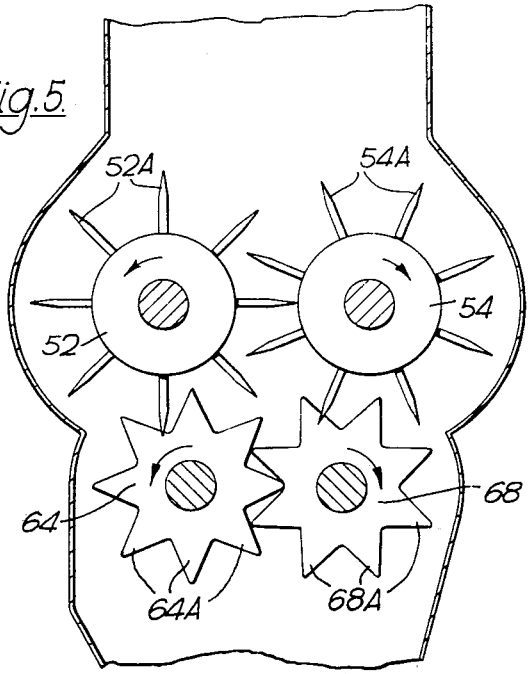
FIG. 5 is an enlarged view of part of FIG. 3.
Figure 6:
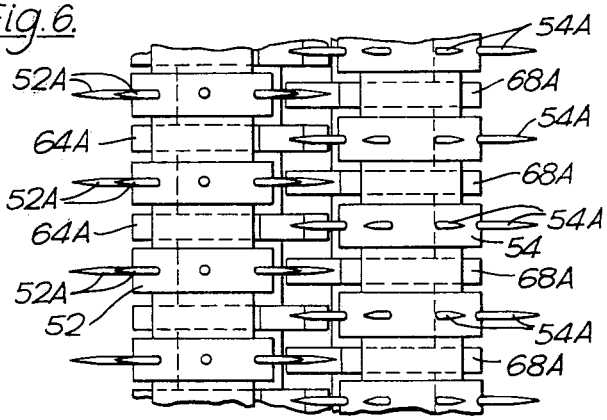
FIG. 6 is a plan view of the apparatus shown in FIG. 5.

FIGS. 5 and 6 show in more detail the tobacco feed formed by the rollers 52, 54, 64 and 68. In particular, FIGS. 5 and 6 make clear the relationship between pin-like spikes 52A and 54A on the rollers 52 and 54, and triangular flat-faced spikes 64A and 68A respectively on the rollers 64 and 68. As shown in FIG. 6, the spikes 52A and 54A on the two upper rollers are staggered relative to one another, as are the spikes 64A and 68A on the lower rollers. Thus there is no danger of interference between the various spikes.

Figure 4:
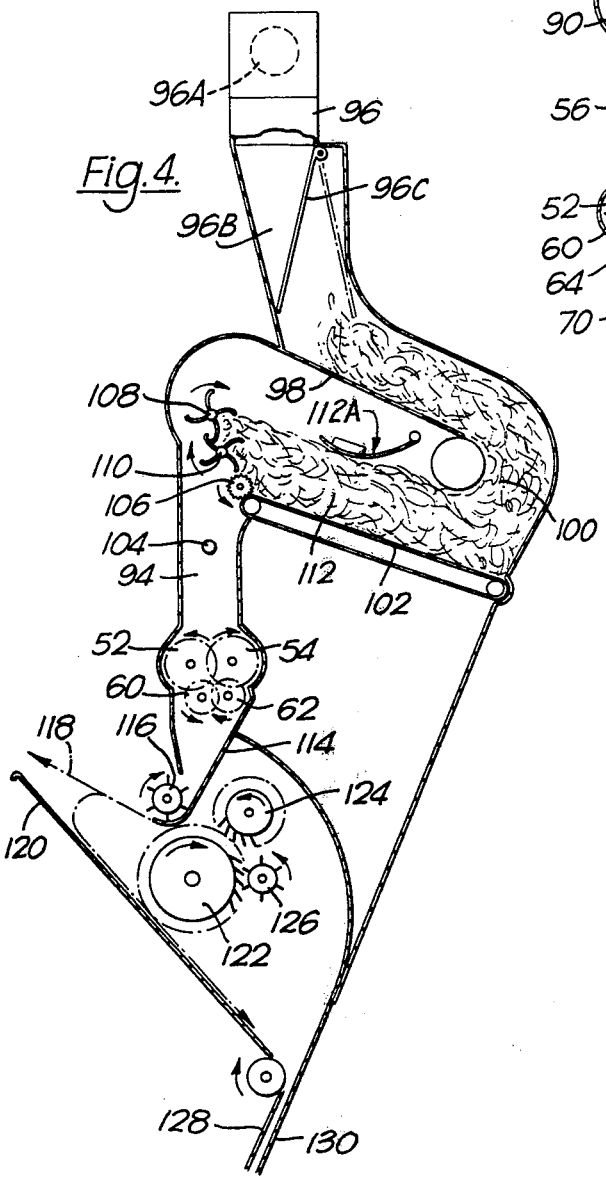

FIG. 4 shows a different arrangement using rollers 52, 54, 60 and 62. In this example, tobacco is fed into a space 94 above the rollers by an arrangement which has a significant buffer capacity and is as follows. Tobacco is fed pneumatically through a pipe 96A of a discharge unit 96. The discharge unit receives tobacco from the pipe 96A, when necessary, and accumulates the tobacco in a space 96B from which it is released, when needed, by swinging open a pivoted flap door 96C. The tobacco then passes downwards along a ramp 98 of low-friction material, round a bend 100 and continues as a fairly thick carpet 112 on a conveyor band 102 which is also of low-friction material. The band 102 may be driven continuously; delivery of the tobacco in to the space 94 (when demanded by a photo-electric or other device 104) occurring when a knurled roller 106 is rotated. The removal of tobacco from the bulk of tobacco on the band 102 is achieved with the aid of rotary doffers 108 and 110. These doffers may stop and start with the knurled roller 106 or may rotate continuously. While no tobacco is being fed into the space 94, the carpet of tobacco 112 remains stationary, and the band 102 slips relative to it. The carpet 112 may be lightly pressed down by a weighted flap 112A.

The ramp 98 may comprise a plate which is oscillated backwards and forwards in its own plane to assist downward movement of the tobacco on the plate. For example, each oscillation cycle may comprise a slow forward movement (i.e. in the direction in which the tobacco is to be conveyed) followed by a rapid return stroke.

Tobacco received from the rollers 52, 54, 60 and 62 slides down a ramp 114 towards a projector roller 116 which projects the tobacco at a relatively high speed approximately in the direction of the arrow 118. Any heavy pieces, lumps or foreign bodies pass over the upper edge of a ramp 120, while lighter particles or lumps of tobacco move on a trajectory which brings them into contact with the ramp 120. The lighter particles and lumps, which to be used in the formation of a cigarette filler stream slide down the ramp 120.

Loose particles of tobacco pass between the ramp 120 and a spiked drum 122. However, any lumps of tobacco are picked up by the drum 122, are stretched by a refuser roller 124 and are then removed from the drum 122 by a high-speed picker roller 126 which projects the tobacco into the upper end of a downwardly extending channel defined by walls 128 and 130. The loose particles of tobacco which slide all the way down the ramp 120 also enter the channel.

The following modifications of the FIG. 4 arrangement are possible. The band 102 and the associated parts for feeding tobacco into the space 94 may be rotated through 90° about a vertical axis through the space 94. In that case the band 102 may be horizontal and may be lengthened, for example so as to extend along nearly or substantially the whole length of the cigarette making machine measured in the direction of the finished cigarette rod (it should be understood in this connection that all the figures of the drawings are cross-sections in planes at right angles to the direction of motion of the finished cigarettes rod); and the discharge unit 96 may deliver tobacco directly onto the upstream end of the band 102, which would be at the end of the machine from which the finished cigarettes are delivered.

The arrangements shown in FIGS. 3 and 4 for delivering tobacco into the space 94 may be interchanged.

Figure 7:
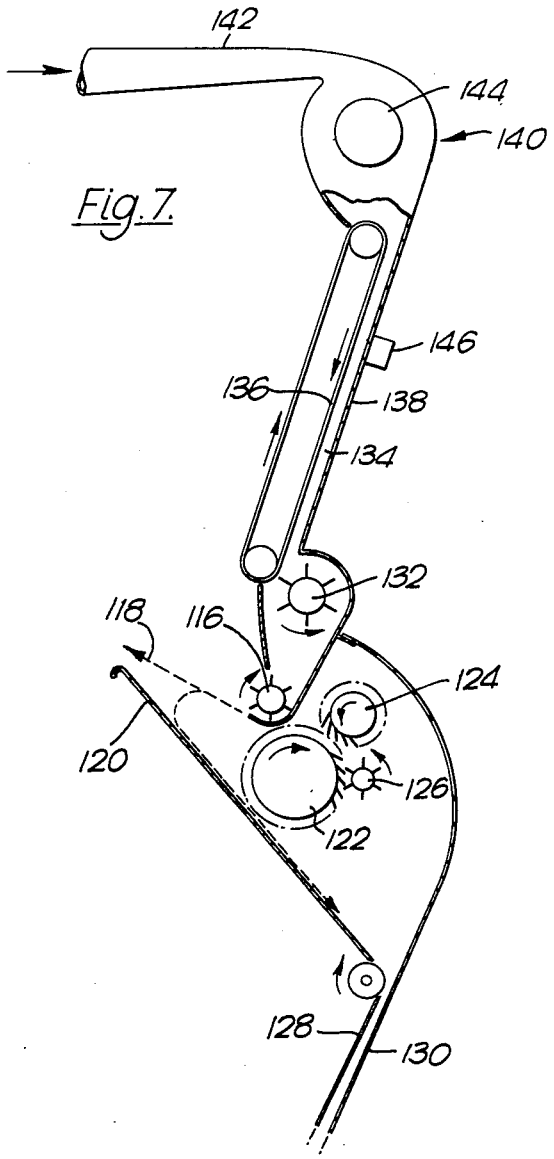

FIG. 7 shows a hopper of which the lower part is similar to that shown in FIG. 4 as indicated by the use of the same reference numerals. Tobacco is, however, fed towards the roller 116 in this example by a spiked roller 132 which receives the tobacco in the form of a thin carpet conveyed downwards through a channel 134 between a conveyor band 136 and a fixed wall 138 of low-friction material. Tobacco enters the channel 134 from an air separator 140 which receives the tobacco in an air stream through an inlet pipe 142. Tobacco builds up in the channel 134 so as to form a seal preventing the flow of air into the air separator, while air passes out of the air separator through a sieve outlet 144. The arrangement of this pneumatic tobacco feed may be generally as described in our British patent specification No. 1,192,177.

Tobacco is fed into the air separator 140 from the pipe 142, when necessary, in response to a photo-electric or other monitoring device 146 which monitors the height of the column of tobacco in the space 134.

Figure 8:
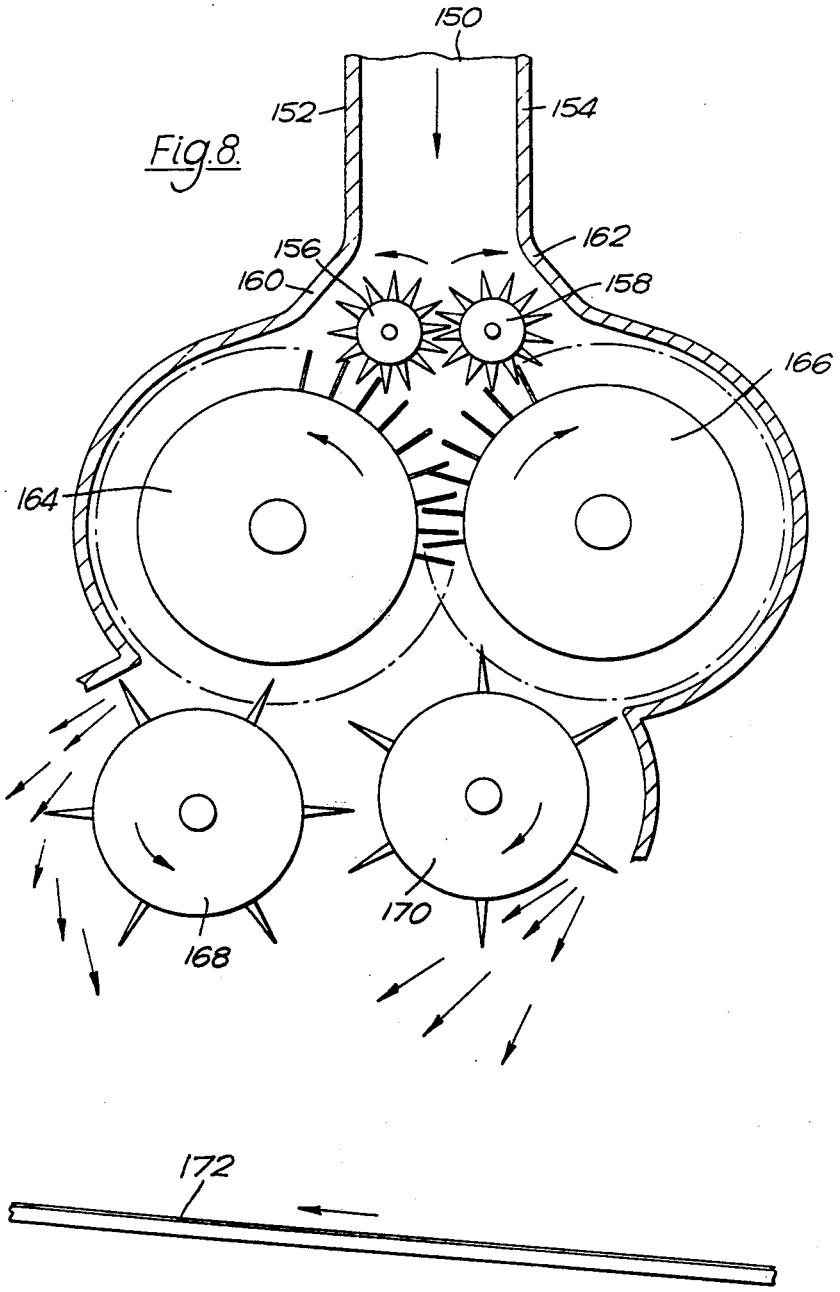
FIG. 8 is a cross-sectional view of part of another different hopper.

FIG. 8 shows an alternative arrangement for feeding tobacco from the lower end of a channel such as the channel 40 shown in FIG. 1. In this example, a channel 150 is provided which extends vertically downwards, being defined by walls 152 and 154 which replace the walls 42 and 44 in FIG. 1. The channel is wider than the channel 40, having a width between the walls 152 and 154 of approximately 34 mm. The width of the channel at the upper end may be slightly less for example 28 mm.

Instead of the carpet of tobacco being fed from the lower end of the channel 150 by a single spiked roller, as in FIG. 1, there are two spiked rollers 156 and 158 rotating in opposite directions so as to divide the carpet into two streams or carpets, one carpet passing between the roller 156 and a fixed wall 160 while the other carpet passes between the roller 158 and a fixed wall 162. The two carpets are removed from the rollers 156 and 158 respectively by spiked rollers 164 and 166. Picker rollers 168 and 170 then remove the tobacco carpets from the rollers 164 and 166 and shower the tobacco downwards onto a band 172; each shower diverges so that the tobacco is spread along the band.

We claim:

1. A hopper for a cigarette making machine and adapted for feeding a stream of tobacco therethrough, said hopper comprising a downwardly extending ramp adapted to allow tobacco to slide freely along said ramp; means for feeding tobacco onto said downwardly extending ramp; a spiked conveyor which is mounted below said feeding means and adjacent to but slightly spaced from the ramp so that it allows loose particles of tobacco to continue to slide past it down the ramp, but picks up lumps of tobacco; and means for opening up the lumps of tobacco picked up by said spiked conveyor and for then delivering that opened up tobacco into said stream of tobacco fed through the hopper.

2. A hopper according to claim 1 further comprising means defining a downwardly extending channel for receiving said loose particles of tobacco together with the tobacco which has been picked up by the spiked conveyor and then opened up and for building it up to form a column of tobacco; and means for feeding the tobacco continuously from the lower end of the channel.

3. A hopper according to claim 2 in which the means for feeding the tobacco continuously from the lower end of the channel comprises two spiked feed rollers mounted for rotation in opposite directions about substantially parallel axes and situated at the lower end of the tobacco space, the rollers being rotated in directions such that each roller feeds downwards a stream of tobacco passing between the roller and an extension of the adjacent wall of the channel; and including two additional spiked rollers arranged respectively to project the tobacco downwards from the two feed rollers.

4. A hopper according to claim 3, including two further spiked rollers mounted above the feed rollers and arranged to divide the tobacco flow from the channel into two carpets which are then received by the feed rollers.

5. A hopper according to claim 1 further comprising means for projecting said tobacco onto the ramp, said projecting means being arranged to project the tobacco in a direction such that heavy pieces or foreign bodies pass over the top of the ramp so that they are separated from the tobacco which slides down the ramp.

6. A hopper according to claim 1 in which the means for opening up the lumps of tobacco carried from the ramp by the spiked conveyor comprise a refuser roller which cooperates with the spiked roller, and a picker roller which removes the tobacco from the spiked roller.

7. A hopper according to claim 1 further comprising means defining a downwardly extending channel for receiving said loose particles of tobacco directly from said ramp to build up a column of loose tobacco within said channel.

8. A hopper for a cigarette making machine, comprising downwardly extending fixed walls defining between them a tobacco space into which tobacco is delivered; two spiked feed rollers mounted for rotation about axes spaced from each other; two additional spiked rollers mounted for rotation adjacent to respective of said feed rollers; and means for rotating said rollers, said rotating means being adapted to rotate said feed rollers in directions such that each feed roller feeds downwards a stream of tobacco passing between the feed roller and a part of the adjacent fixed wall; said additional spiked rollers being arranged respectively to project the tobacco downwards from the two feed rollers.

9. A hopper according to claim 8 in which said rotating means is arranged to rotate said additional spiked rollers at a significantly higher speed than the feed rollers.

10. A hopper according to claim 9 in which said rotating means is arranged to rotate each of the additional rollers in the same direction as the roller adjacent to it.

11. A hopper according to claim 8 including means defining two downwardly-extending channels which respectively receive the two streams of tobacco projected downwards by the two additional rollers; and means for feeding tobacco from one channel at a time.

12. A hopper according to claim 11 in which the two channels are defined by two fixed walls and a pivoted member which lies between the fixed walls and is pivoted at its upper end so that it can be moved between two positions in which it allows tobacco to pass down one or other channel while arresting the flow of tobacco through the other channel.

13. A hopper according to claim 8 in which the tobacco projected downwards from the two feed rollers is received by a first spiked conveyor which, along a portion of its spiked surface, is arranged to carry tobacco along part of its path of conveyance through the hopper, and including a second spiked conveyor which carries the tobacco along another part of its path of conveyance through the hopper, a second portion of the first spiked conveyor being arranged to cooperate with the second spiked conveyor to provide a refusing, lump-stretching or similar action on the tobacco while it is being carried by the second spiked conveyor.

14. A hopper according to claim 8 including a ramp; means for feeding onto the ramp the tobacco projected downwards from the two feed rollers; a spiked conveyor which is mounted adjacent to but slightly spaced from the ramp so that it allows a stream of loose particles of tobacco to slide past it down the ramp, but picks up lumps of tobacco; and means for opening up the lumps of tobacco picked up by said spiked conveyor and for then delivering that tobacco onto said stream of loose tobacco.

15. A hopper according to claim 8 wherein said two spiked feed rollers are mounted for rotation in opposite directions about substantially parallel axes.

16. A hopper for directing a stream tobacco along a path towards a cigarette making machine, comprising a downwardly inclined ramp extending along said path, said ramp being adapted to allow tobacco to slide freely down said ramp; means for feeding tobacco along said path onto said ramp; means for removing any tobacco in the form of lumps from the tobacco sliding down said ramp and for returning the removed tobacco to the stream of tobacco directed along said path, said means including a spiked conveyor arranged below said feeding means and adjacent to but slightly spaced from said ramp to pick up said lumps of tobacco while allowing loose particles of tobacco to continue to slide past it down the ramp; and means for opening up said lumps of tobacco; whereby all of the tobacco discharged from said hopper is in the form of loose particles.

17. A hopper according to claim 16 further comprising means defining a downwardly extending channel for receiving said loose particles of tobacco directly from said ramp to build up a column of loose tobacco within said channel.

18. A hopper for a cigarette making machine and adapted for feeding a stream of tobacco therethrough, said hopper comprising a downwardly extending ramp; means for feeding tobacco onto said downwardly extending ramp at a first station along said ramp; a spiked conveyor mounted adjacent to but slightly spaced from said ramp at a second station below said first station such that it allows loose particles of tobacco to slide past it down said ramp but picks up lumps of tobacco; and means for opening up said lumps of tobacco picked up by said spiked conveyor and for then delivering that opened up tobacco into said stream of tobacco fed through said hopper.

19. A hopper according to claim 18 in which said tobacco feeding means comprises means for projecting said tobacco through space and onto said ramp, said first station encompassing a range of positions along said ramp at which tobacco particles of differing physical characteristics strike said ramp.

20. A hopper according to claim 18 further comprising means defining-a downwardly extending channel for receiving said loose particles of tobacco directly from said ramp to build up a column of loose tobacco within said channel.

21. A hopper for directing tobacco along a path towards a cigarette making machine, comprising a downwardly inclined ramp extending along said path; means for feeding tobacco along said path onto said ramp at a first station along said ramp; means for removing any tobacco in the form of lumps from the tobacco sliding down said ramp and for returning the removed tobacco to the tobacco directed along said path, said means including a spiked conveyor arranged adjacent to but slightly spaced from said ramp at a second station below said first station to pick up said lumps of tobacco while allowing loose particles of tobacco to slide past it down the ramp; and means for opening up said lumps of tobacco; whereby all of the tobacco discharged from said hopper is in the form of loose particles.

22. A hopper according to claim 21 in which said tobacco feeding means comprises means for projecting said tobacco through space and onto said ramp, said first station encompassing a range of positions along said ramp at which tobacco particles of differing physical characteristics strike said ramp.

23. A hopper according to claim 21, including means defining a downwardly extending channel for receiving said loose particles of tobacco directly from said ramp to build up a column of loose tobacco within said channel.

* * * * *